US008708136B2

(12) United States Patent
Bednarz et al.

(10) Patent No.: US 8,708,136 B2
(45) Date of Patent: Apr. 29, 2014

(54) DRIVE TRANSMISSION METHOD IN A LONGWALL SHEARER LOADER

(75) Inventors: Ryszard Bednarz, Katowice (PL); Pawel Gwiaździński, Żernica (PL); Lukasz Gonsior, Marklowice (PL); Mateusz Golabek, Dabrowa Gómicza (PL)

(73) Assignees: Famur Spolka Akcyjna, Katowice (PL); Famur Institute SP. ZO.O., Katowice (PL)

( * ) Notice: Subject to any disclaimer, the term of this patent is extended or adjusted under 35 U.S.C. 154(b) by 0 days.

(21) Appl. No.: 13/509,251

(22) PCT Filed: Nov. 2, 2010

(86) PCT No.: PCT/PL2010/000108

§ 371 (c)(1),
(2), (4) Date: Jul. 30, 2012

(87) PCT Pub. No.: WO2011/059348

PCT Pub. Date: May 19, 2011

(65) Prior Publication Data

US 2012/0279831 A1 Nov. 8, 2012

(30) Foreign Application Priority Data

Nov. 10, 2009 (PL) ..... 389530

(51) Int. Cl.
*B65G 23/00* (2006.01)

(52) U.S. Cl.
USPC ..... 198/729; 198/728

(58) Field of Classification Search
USPC ..... 198/717, 722, 725, 726, 727, 728, 729
See application file for complete search history.

(56) References Cited

U.S. PATENT DOCUMENTS

| | | | | |
|---|---|---|---|---|
| 1,979,266 | A | 11/1934 | Holmes | |
| 3,282,627 | A | 11/1966 | Arndt | |
| 3,333,895 | A | 8/1967 | Anderson | |
| 3,727,801 | A * | 4/1973 | Caridis et al. | 198/734 |
| 3,844,629 | A * | 10/1974 | Haines | 384/43 |
| 3,876,252 | A | 4/1975 | Cilles | |

(Continued)

FOREIGN PATENT DOCUMENTS

| | | |
|---|---|---|
| DE | 3420548 A1 | 12/1985 |
| GB | 2047774 A | 12/1980 |

(Continued)

OTHER PUBLICATIONS

International Search Report for PCT/PL2010/000108, mailed Aug. 24, 2011.

(Continued)

*Primary Examiner* — James R Bidwell
(74) *Attorney, Agent, or Firm* — Roberts Mlotkowski Safran & Cole, P.C.

(57) ABSTRACT

A longwall shearer loader is provided. The longwall shearer loader includes a shearer body located outside of an armored face conveyor. Additionally, the longwall shearer loader includes a motor and a transmission unit that propel a drive shaft located in a part of the shearer body, which is above the armored face conveyor. The drive shaft transmits power to a drive wheel installed in the shearer body on a goaf side, which is outside of a line pan of the chain conveyor and which moves along a ladder.

4 Claims, 1 Drawing Sheet

(56) References Cited

U.S. PATENT DOCUMENTS

| | | | | |
|---|---|---|---|---|
| 4,082,361 | A | 4/1978 | Lanfermann | |
| 5,913,403 | A * | 6/1999 | Merten et al. | 198/733 |
| 5,964,507 | A | 10/1999 | Blackstock | |
| 2012/0284999 | A1 | 11/2012 | Bednarz et al. | |

FOREIGN PATENT DOCUMENTS

| | | | |
|---|---|---|---|
| GB | 2088445 | A | 6/1982 |
| PL | 180563 | B1 | 2/2001 |
| PL | 188549 | B1 | 2/2005 |
| PL | 199858 | B1 | 11/2008 |

OTHER PUBLICATIONS

International Search Report of PCT/PL2010/000109 dated Aug. 24, 2011 (co-pending application).

* cited by examiner

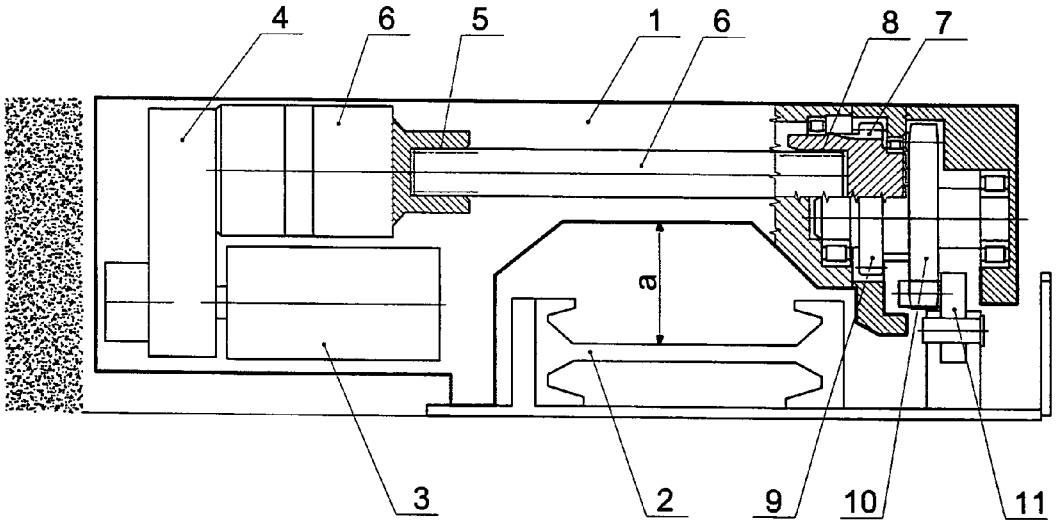
4
6
5
1
6
8
7
a
3
2
9
10
11

DRIVE TRANSMISSION METHOD IN A LONGWALL SHEARER LOADER

CROSS-REFERENCE TO RELATED APPLICATIONS

The present Application is a U.S. National Phase Application of International Application PCT/PL2010/000108 filed on Nov. 2, 2010, which claims priority from Polish Application No. P-389530 filed on Nov. 10, 2009, both of which are hereby incorporated by reference in their entirety into the present Application.

BACKGROUND

1. Field of the Invention

The subject of the invention is a drive transmission in a longwall shearer loader.

2. Description of Related Art

A coal shearer equipped with a feed haulage gear without wrapping connectors has already been described in the Polish description of the patent No. 170568. Such a shearer is equipped with a drive gear and an idle wheel toothed with the drive gear. Both are located in a specially shaped part of the haulage gear body. The idle wheel cooperates with a ladder and is guided along it by guides. The idle wheel is mounted in a detachable housing, which is attached to the body of the haulage gear. The housing's shape resembles a rectangle, whose upper comer located above the idle wheel has been truncated. The bottom edge of the housing protrudes outside of the lower part of the haulage gear body.

A drive transmission unit, particularly the one used in cutter-loaders, has already been described in the Polish description of the patent No. 172361. The unit is composed of a drive gear and an identical idle wheel toothed with the drive gear, which at the same time functions as a fast wheel cooperating with an inflexible pin connector or with a chain connector. The idle wheel is fixed to the shearer frame, which may be disconnected from the haulage gear. The module drive gear mounted on the drive shaft of the haulage gear cooperates with the module idle wheel mounted on the axle, where the fast wheel is mounted, too. The module idle wheel is fixed in relation to the fast wheel and the axle is fixed in the holder.

A haulage gear has already been described in the Polish description of the patent No. 180563. The mechanism is composed of a gear wheel mounted on a drive shaft and a module idle wheel mounted on the axle, which is fixed in a holder. The holder (detachable) is connected with the haulage gear body and a frame of the shearer slide and is equipped with a cover. The idle wheel is located between the gear wheel and the drive gear unit and is mounted on the axle, which is fixed in the hubs equipped with eccentric bushes. One hub along with its eccentric bush is fixed in the housing of the holder. The other hub along with its eccentric bush is fixed in the cover of the holder.

A drive transmission unit used in cutter-loaders has also been described in the Polish description of the patent No. 188549. The unit, also referred to as the housing fixed to the front panel of the haulage gear and the shearer frame, is composed of a drive gear toothed with a fast gear wheel mounted on the axle located in the housing and a shoe. The axle of the fast wheel is mounted in the inlets located in the 35 openings. One inlet is mounted in a recess in the plate and the other one in the housing's cover.

SUMMARY

A drive transmission for a longwall shearer loader, according to the invention, is characterised by the fact that in the shearer body, on the coal face side, in the part located outside of an armoured face conveyor, there is a motor and a transmission unit propelling a drive shaft located in the part of the shearer body situated above the armoured face conveyor. The drive shaft transmits power to a drive wheel installed in the shearer body on the goaf side, which is outside of a line pan of the armoured face conveyor and which moves along a ladder.

On one side, the drive shaft is fixed in a coupling of the transmission unit and, on the other side, in a coupling of the idle wheel or directly in the coupling of the drive wheel.

The drive transmission for a longwall shearer loader based on the invention enables constructing a uniform shearer body, which translates into improved structural rigidity and reduces shearer's height above the conveyor while maintaining the maximum "a" clearance. The solution proposed in the invention significantly improves maintenance conditions; especially in the case it is necessary to replace a drive wheel.

BRIEF DESCRIPTION OF THE DRAWING

An example of the subject of the invention has been presented in the drawing, where FIG. 1 indicates a schematic drive transmission in a longwall shearer loader.

DETAILED DESCRIPTION

A motor 3 along with the transmission unit 4, propelling a drive shaft 6 located in the part of the shearer body 1 located above the armoured face conveyor 2, is installed in the body of the shearer 1 on the coal face side in the part outside of the armoured face conveyor 2. The drive shaft transmits the power to a drive wheel 10 installed in the shearer body 1 on the goaf side outside, of the line pan of the armoured face conveyor 2 and moving along the ladder 11.

On the one side the drive shaft 6 is fixed in a coupling 5 of the transmission unit 4 and, on the other side, in a coupling 8 of the idle wheel 7 or directly in the coupling of the drive wheel 10.

The invention claimed is:

1. A drive transmission for a longwall shearer loader equipped with a transmission unit propelling a drive wheel cooperating with a ladder, the drive transmission comprising:

a shearer body, on a coal face side, in a part located outside of an armoured face conveyor; and a motor and a transmission unit that propel a drive shaft located in a part of the shearer body situated above the armoured face conveyor, wherein:

the drive shaft transmits the power to the drive wheel, the drive wheel is installed in the shearer body on a goaf side, outside of a line pan of the armoured face conveyor, and moving along the ladder.

2. The drive transmission according to claim 1, wherein the drive shaft is fixed on one side in a coupling of the transmission unit and another side in a coupling of an idle wheel or directly in a coupling of the drive wheel.

3. The drive transmission system of claim 1, wherein the drive shaft is fixed to a coupling on the transmission unit on the first side of the longwall shearer loader and fixed to a coupling on an idle wheel or fixed directly to a coupling on the drive wheel on the second side of the longwall shearer loader.

4. A drive transmission system for a longwall shearer loader, the drive transmission system comprising:

a motor positioned on a first side of the longwall shearer loader;

a transmission unit positioned on the first side of the longwall shearer loader;

a drive shaft positioned in the longwall shearer loader above an armoured face conveyor;

a drive wheel positioned on a second side of the longwall shearer loader; and a ladder positioned on the second side of the longwall shearer loader, wherein:

the motor and the transmission unit are in communication and configured to propel the drive shaft;

the drive shaft is connected to the transmission unit and the drive wheel such that the drive shaft is configured to transmit power from the motor on the first side of the longwall shearer loader to the drive wheel on the second side of the long wall shearer loader;

the drive wheel is in communication with the ladder and configured to move along the ladder; and the armoured face conveyor is positioned between the first side and the second side of the longwall shearer loader.

* * * * *